US009952609B2

(12) United States Patent
Zhang et al.

(10) Patent No.: US 9,952,609 B2
(45) Date of Patent: Apr. 24, 2018

(54) LOW DROP-OUT REGULATOR CIRCUIT, CHIP AND ELECTRONIC DEVICE

(71) Applicant: CSMC TECHNOLOGIES FAB1 CO., LTD., Wuxi New District (CN)

(72) Inventors: Nan Zhang, Wuxi New District (CN); Jing Zhou, Wuxi New District (CN)

(73) Assignee: CSMC TECHNOLOGIES FABI CO., LTD., Wuxi New District, Jiangsu (CN)

( * ) Notice: Subject to any disclaimer, the term of this patent is extended or adjusted under 35 U.S.C. 154(b) by 0 days.

(21) Appl. No.: 15/327,916

(22) PCT Filed: Aug. 18, 2015

(86) PCT No.: PCT/CN2015/087312
§ 371 (c)(1),
(2) Date: Jan. 20, 2017

(87) PCT Pub. No.: WO2016/026416
PCT Pub. Date: Feb. 25, 2016

(65) Prior Publication Data

US 2017/0212539 A1 Jul. 27, 2017

(30) Foreign Application Priority Data

Aug. 19, 2014 (CN) ..... 2014 1 0408726

(51) Int. Cl.
*G05F 1/56* (2006.01)
*G05F 1/575* (2006.01)
*G05F 1/46* (2006.01)

(52) U.S. Cl.
CPC ..... *G05F 1/468* (2013.01); *G05F 1/56* (2013.01); *G05F 1/575* (2013.01)

(58) Field of Classification Search
CPC . G05F 1/00; G05F 1/465; G05F 1/468; G05F 1/56; G05F 1/575; G05F 3/00;
(Continued)

(56) References Cited

U.S. PATENT DOCUMENTS 4,876,534 A * 10/1989 Mead ..... H04N 5/335 340/14.2
5,578,960 A * 11/1996 Matsumura ..... G05F 1/56 323/276
(Continued)

FOREIGN PATENT DOCUMENTS

CN 101089770 A 12/2007
CN 101364119 A 2/2009
(Continued)

OTHER PUBLICATIONS

English Translation of International Search Report for International Application No. PCT/CN/087312, dated Oct. 27, 2015.
(Continued)

*Primary Examiner* — Lincoln Donovan
*Assistant Examiner* — David Mattison
(74) *Attorney, Agent, or Firm* — Kagan Binder, PLLC

(57) ABSTRACT

A low dropout linear regulator circuit comprises a voltage reference source module (100), an error amplifier (200), a reference voltage determining module (300), a power transmission device (400) and a feedback module (500); wherein the voltage reference source module (100) provides a reference voltage for the error amplifier (200), the reference voltage determining module (300) controls an enablement of the error amplifier (200) according to whether the voltage reference source module (100) is completely started, the error amplifier (200) controls ON/OFF of the power transmission device (400) according to the reference voltage provided by the voltage reference source module (100) and a feedback voltage provided by the feedback module (500). A chip having the above low dropout linear regulator circuit and a electronic device having the above chip are provided.

12 Claims, 3 Drawing Sheets

(58) Field of Classification Search
CPC . G05F 3/24; G05F 3/247; G05F 3/262; G11C 5/00; G11C 5/147
USPC ..... 327/541
See application file for complete search history.

(56) References Cited

U.S. PATENT DOCUMENTS

| | | | | |
|---|---|---|---|---|
| 6,630,858 | B1 * | 10/2003 | Takabayashi | G05F 1/575 327/538 |
| 7,622,902 | B1 | 11/2009 | Kao et al. | |
| 2007/0290665 | A1 * | 12/2007 | Moraveji | G05F 1/575 323/274 |
| 2013/0057320 | A1 * | 3/2013 | Liu | H04L 25/0276 327/108 |

FOREIGN PATENT DOCUMENTS

| | | | |
|---|---|---|---|
| CN | 102495656 | A | 6/2012 |
| CN | 102591400 | A | 7/2012 |
| CN | 102650893 | A | 8/2012 |
| CN | 202362691 | U | 8/2012 |
| CN | 202404470 | U | 8/2012 |
| CN | 103092243 | A | 5/2013 |
| CN | 103412602 | A | 11/2013 |
| CN | 103529890 | A | 1/2014 |
| JP | H06110567 | A | 4/1994 |
| JP | 2010224825 | A | 10/2010 |

OTHER PUBLICATIONS

Deng et al., U.S. Appl. No. 14/902,516, filed Jul. 29, 2014.
Zhong et al., U.S. Appl. No. 14/902,517, filed Jul. 22, 2014.
Zhang et al., U.S. Appl. No. 14/902,519, filed Aug. 19, 2014.
Wang et al., U.S. Appl. No. 14/902,302, filed Sep. 2, 2014.
Zhang et al., U.S. Appl. No. 15/023,049, filed Dec. 2, 2014.
Jing et al., U.S. Appl. No. 15/023,057, filed Dec. 4, 2014.
Hu et al., U.S. Appl. No. 15/119,249, filed May 8, 2015.
Wang et al, U.S. Appl. No. 15/119,289, filed Apr. 29, 2015.
Qian et al., U.S. Appl. No. 15/119,311, filed May 6, 2015.
Zhang et al., U.S. Appl. No. 15/308,574, filed May 4, 2015.
Han et al., U.S. Appl. No. 15/318,857, filed Jun. 30, 2015.
Hu et al., U.S. Appl. No. 15/312,146, filed May 5, 2015.
Yao, U.S. Appl. No. 15/315,168, filed Jun. 26, 2015.
Office Action from counterpart Chinese Patent Application No. 201410408726.9 and English Translation thereof, dated Aug. 2, 2016 and related Search Report (14 pages).

* cited by examiner

LOW DROP-OUT REGULATOR CIRCUIT, CHIP AND ELECTRONIC DEVICE

FIELD OF THE INVENTION

The present invention relates to a technical field of the semiconductor device, and particularly relates to a low dropout linear regulator circuit, a chip and an electronic device.

BACKGROUND OF THE INVENTION

Output capacitor-less low dropout linear regulator (LDO) circuit has become the first choice for power management in mobile electronic devices due to its advantages of simple structure, low cost, low noise, low power consumption, small package size and the like. Because it can omit the external capacitor and the bonding gold wire at the output, the cost of the product can be effectively reduced, and then the output capacitor-less low dropout linear regulator circuit is gradually applied in SOC products.

The output capacitor-less low dropout linear regulator circuit is formed mainly by the following parts: a voltage reference source, an error amplifier, a power transmission device, and a feedback circuit. The error amplifier compares the feedback voltage of the feedback circuit with the reference voltage of the voltage reference source, and amplifies the difference therebetween to control the conduction state of the power transmission device to obtain a stable output voltage. However, in the process of just power on, the loop just started to work, and then the error amplifier cannot effectively control operation of the power transmission device, so there will be a conduction stage for the power transmission device, which will cause the input voltage to be directly output to the output voltage terminal, resulting in the voltage overshoot. Because the parasitic capacitance of the output voltage terminal is comparatively small, the voltage overshoot will have a greater impact on the voltage of the output voltage terminal.

SUMMARY OF THE INVENTION

Accordingly, it is necessary to provide a low dropout linear regulator circuit, which can effectively avoid the voltage overshoot.

A low dropout linear regulator circuit includes a voltage reference source module, an error amplifier, a reference voltage determining module, a power transmission device and a feedback module; wherein the voltage reference source module provides a reference voltage for the error amplifier, the reference voltage determining module controls an enablement of the error amplifier according to whether the voltage reference source module is completely started, the error amplifier controls ON/OFF of the power transmission device according to the reference voltage provided by the voltage reference source module and a feedback voltage provided by the feedback module.

A chip includes the above low dropout linear regulator circuit.

An electronic device includes the above chip.

The low dropout linear regulator circuit, the chip and the electronic device described above are applied to the output capacitor-less LDO circuit, and include a reference voltage determining module to detect whether the voltage reference source module has completed starting thereof or not. If the voltage reference source module has completed starting thereof, a starting signal is transmitted to the error amplifier, that is, by delaying the starting time of the error amplifier relative to the voltage reference source module, so that the error amplifier can effectively control the operation of the power transmission device, thus avoiding the voltage overshoot in the starting process of the output capacitor-less LDO circuit.

BRIEF DESCRIPTION OF THE DRAWINGS

To illustrate the technical solutions according to the embodiments of the present invention or in the prior art more clearly, the accompanying drawings for describing the embodiments or the prior art are introduced briefly in the following. Apparently, the accompanying drawings in the following description are only some embodiments of the present invention, and persons of ordinary skill in the art can derive other drawings from the accompanying drawings without creative efforts.

DETAILED DESCRIPTION OF THE EMBODIMENTS

The above objects, features and advantages of the present invention will become more apparent by describing in detail embodiments thereof with reference to the accompanying drawings.

The specific embodiments of the invention will be described in detail with reference to the accompanying drawings in the following. In the following description, for convenient understanding, the signal terminal symbol is referenced to indicate the signal, or the signal symbol is referenced to indicate the signal terminal.

Figure 1:
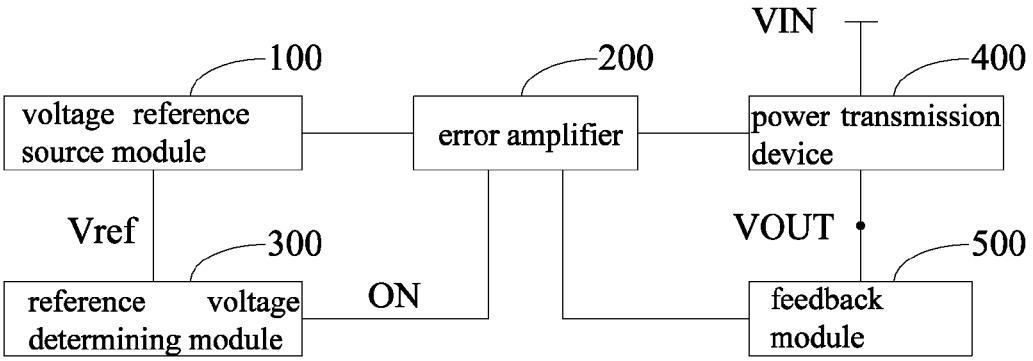
FIG. 1 is a block diagram of a low dropout linear regulator circuit in an embodiment.

Referring to FIG. 1, in an embodiment, a low dropout linear regulator circuit includes a voltage reference source module 100, an error amplifier 200, a reference voltage determining module 300, a power transmission device 400 and a feedback module 500. The voltage reference source module 100 provides a reference voltage for the error amplifier 200, the reference voltage determining module 300 controls an enablement of the error amplifier 200 according to whether the voltage reference source module 100 is completely started, the error amplifier 200 controls ON/OFF of the power transmission device 400 according to the reference voltage provided by the voltage reference source module 100 and a feedback voltage provided by the feedback module 500. VIN is an input voltage terminal while indicating an input voltage and VOUT is an output voltage terminal while indicating an output voltage.

The above low dropout linear regulator circuit is applied to the output capacitor-less LDO circuit, and include the reference voltage determining module 300 to detect whether the voltage reference source module has completed starting thereof or not by sampling the reference voltage Vref. If the voltage reference source module 100 has completed starting thereof, a starting signal ON is transmitted to the error amplifier 200, that is, by delaying the starting time of the error amplifier 200 relative to the voltage reference source module 100, so that the error amplifier 200 can effectively control the operation of the power transmission device, thus avoiding the voltage overshoot in the starting process of the output capacitor-less LDO circuit.

Referring to FIG. 1, the specific connection relationship of the above low dropout linear regulator circuit is as follow:

The voltage reference source module 100 includes a first out connected to an inverting input (−) of the error amplifier 200, and a second output connected to a determining signal input Vref of the reference voltage determining module 300.

The reference voltage determining module 300 includes the determining signal input Vref, and a determining signal output connected to an enable of the error amplifier 200.

The error amplifier 200 includes the inverting input (−), the enable, an amplification signal output connected to a control terminal of the power transmission device 400, and a non-inverting input (+) connected to a feedback terminal of the feedback module 500. The enable can be the negative power source terminal of the error amplifier 200.

The power transmission device 400 includes the control terminal, a switching input connected to the input voltage terminal VIN, and a switching output connected to a current input of the feedback module 500.

The feedback module 500 includes the feedback terminal and the current input.

Figure 2:
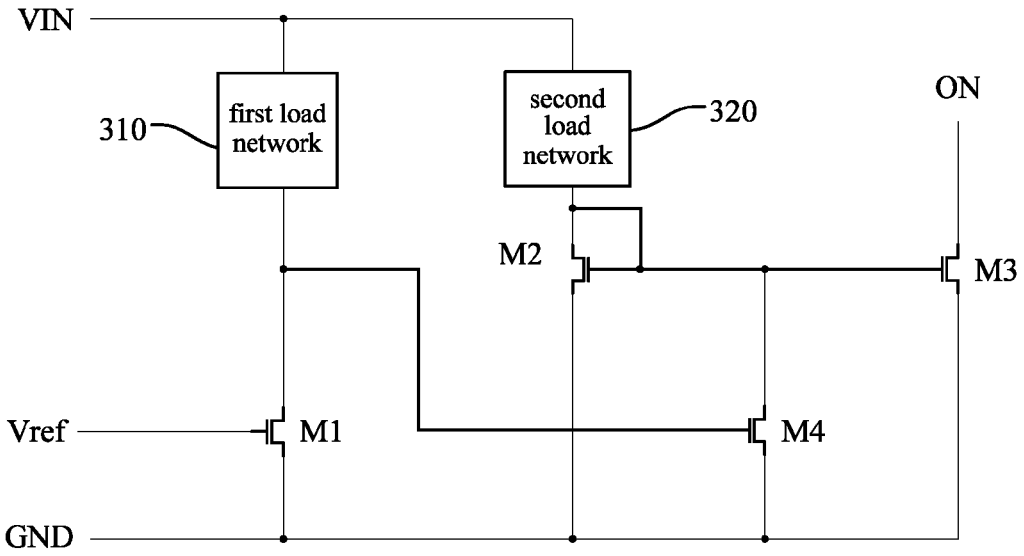
FIG. 2 is a principle diagram of a reference voltage determining module in an embodiment.

FIG. 2 is a principle diagram of the reference voltage determining module in an embodiment.

In the following description, a first electrode of a transistor is a source, and a second electrode of the transistor is a drain.

The reference voltage determining module 300 includes a first transistor M1, a second transistor M2, a third transistor M3 and a fourth transistor M4; wherein the third transistor M3 and the second transistor M2 forms a mirror current source, the input voltage terminal VIN provides a reference current for the mirror current source. The first transistor M1, the second transistor M2, the third transistor M3 and the fourth transistor M4 are N channel field effect transistor.

A gate of the first transistor M1 serves as the determining signal input Vref, which is configured to control a gate of the second transistor M2 to turn on the input voltage terminal VIN or to be grounded GND.

A first electrode of the fourth transistor M4 is connected to a common-gate terminal of the mirror current source, a second electrode of the fourth transistor M4 is grounded, which is configured to control the mirror current source to provide a determining signal ON for the error amplifier 200, that is, provide a bias current for the enable of the error amplifier 200 so that the error amplifier 200 can operate.

The input voltage terminal VIN is connected to a first electrode of the first transistor M1 and a gate of the fourth transistor M4 by the first load network 310, and the input voltage terminal VIN is connected to the first electrode of the second transistor M2 by the second load network 320; the second electrodes of the first transistor M1, the second transistor M2, the third transistor M3, and the fourth transistor M4 are grounded; the gate of the third transistor M3 and a gate of the second transistor M2 are connected to serve as the common-gate terminal of the mirror current source; the first electrode and the gate of the second transistor M2 are short-connected; a first electrode of the third transistor M3 serves as the determining signal output terminal ON.

When the input voltage terminal VIN is powered on, the voltage reference source module 100 begins to start, the bias current in the voltage reference source module 100 begins to operate normally, the reference voltage Vref begins to rise, and the determining signal input of the reference voltage determining module 300 begins to sample the reference voltage Vref.

When the reference voltage Vref is equal to or less than the starting voltage VR of the first transistor M1, the gate voltage of the first transistor M1 is insufficient to turn on the first transistor M1; at this time, the gate voltage of the fourth transistor M4 is the high level; the fourth transistor M4 is turned on and the gate (connected to the common-gate terminal of the mirror current source) of the third transistor M3 is grounded, and the gate voltage of the third transistor M3 is pulled down, so that the third transistor M3 cannot provide the bias current for the error amplifier 200.

When the reference voltage Vref rises to the starting voltage VR, the first transistor M1 is sufficiently turned on, the gate of the fourth transistor M4 is grounded, and the gate voltage of the fourth transistor M4 is pulled down, so that the fourth transistor M4 is switched from ON to OFF, and the mirror current source operates; at this time, the third transistor M3 provides a bias current for the error amplifier 200.

By properly controlling the time that the reference voltage Vref rises to the starting voltage VR, the voltage overshoot in the starting process of the circuit can be effectively avoid.

In some embodiments, the embodiments described above may also be improved, wherein the first load network 310 and the second load network 320 can be embodied as a first resistor R1 and a second resistor R2, respectively, to limit the current and the voltage, or the first load network 310 and the second load network 320 are embodied as the fifth transistor M5 and the sixth transistor M6, respectively, to cooperate with operation of the first transistor M1 and the second transistor M2. The fifth transistor M5 and the sixth transistor M6 are P channel field effect transistors.

Figure 3:
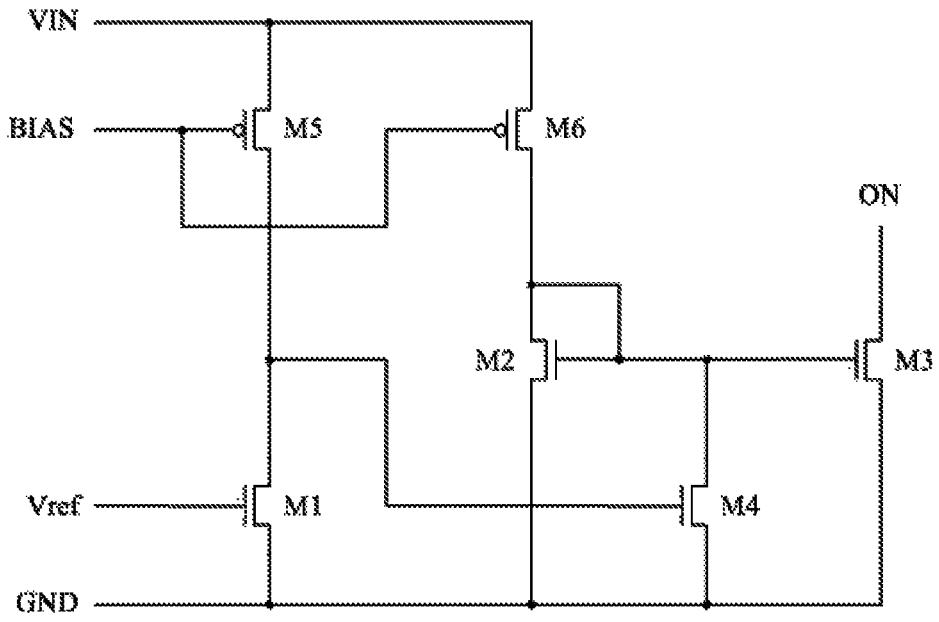
FIG. 3 is a principle diagram of a reference voltage determining module in another embodiment.

Referring to FIG. 3, the voltage reference source module 100 is connected to a gate of the fifth transistor M5 and a gate of the sixth transistor M6 to provide a bias voltage BIAS. The input terminal VIN is connected to the second electrode of the fifth transistor M5 and the second electrode of the sixth transistor M6, the first electrode of the fifth transistor M5 is connected to the first electrode of the first transistor M1 and the gate of the fourth transistors M4, the first electrode of the sixth transistor M6 is connected to the first electrode of the second transistor M2.

Figure 4:
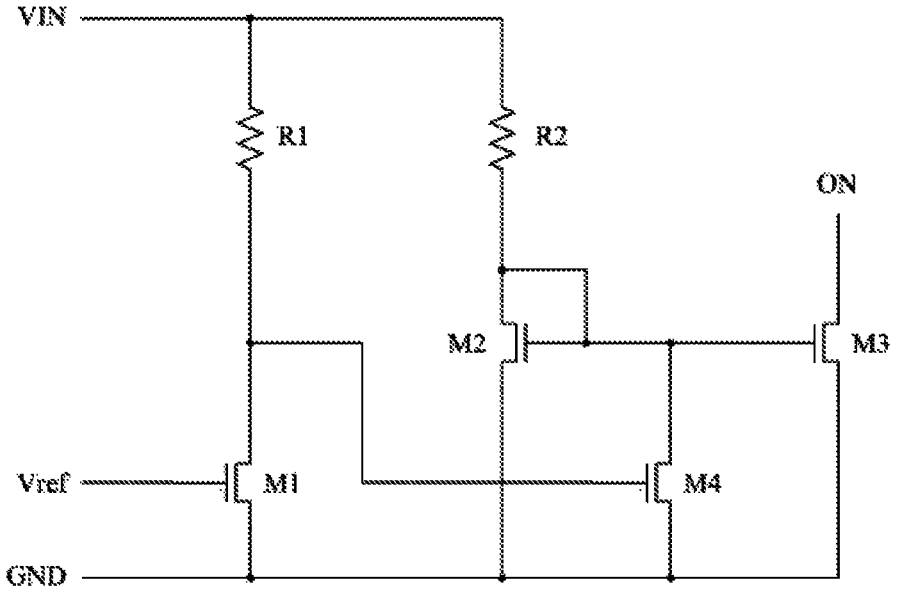
FIG. 4 is a principle diagram of a reference voltage determining module in yet another embodiment.

In other embodiments, the input voltage terminal VIN is connected to the first electrode of the first transistor M1 by the first resistor R1, the input voltage terminal VIN is connected to the gate of the fourth transistor M4 by the first resistor R1, and the input voltage terminal VIN is connected to the first electrode of the second transistor M2 by the second resistor R2, as shown in FIG. 4.

Figure 5:
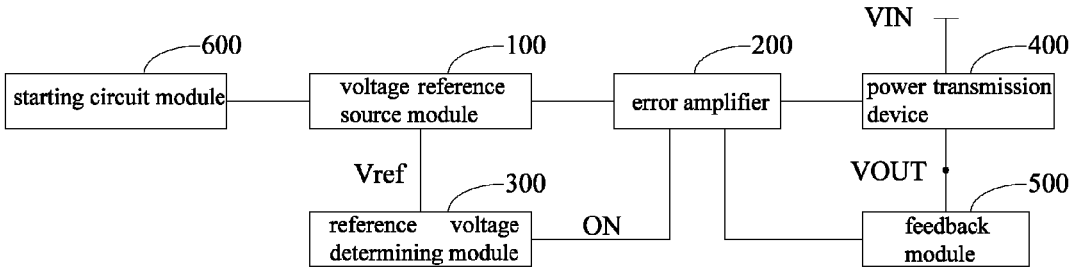
FIG. 5 is a block diagram of a low dropout linear regulator circuit in another embodiment.
Figure 6:
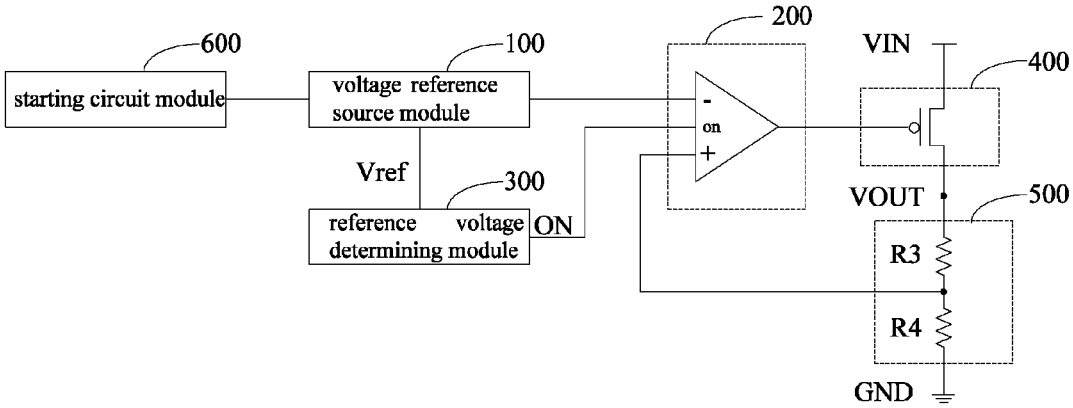
FIG. 6 is a principle diagram of a low dropout linear regulator circuit in another embodiment.

FIG. 5 is a block diagram of the low dropout linear regulator circuit in another embodiment, which can be referred in connection with FIG. 6.

A low dropout linear regulator circuit includes a voltage reference source module 100, an error amplifier 200, a reference voltage determining module 300, a power transmission device 400, a feedback module 500 and a starting circuit module 600. The starting circuit module 600 is configured to control starting of the voltage reference source module 100.

The starting circuit 600 controls connection of the voltage reference source module 100, wherein the first output of the voltage reference source module 100 is connected to the inverting input− of the error amplifier 200, and the second output of the voltage reference source module 100 is connected to the determining signal input Vref of the reference voltage determining module 300, the determining signal output ON of the reference voltage determining module 300 is connected to the enable on of the error amplifier 200, the amplification signal output of the error amplifier 200 is connected to the control terminal of the power transmission device 400, the non-inverting input+ of the error amplifier 200 is connected to the feedback terminal of the feedback module 500, the switching input of the power transmission device 400 is connected to the input voltage, and the switching out of the power transmission device 400 is connected to the current input of the feedback module 500. The enable on of the error amplifier 200 may be the negative power source terminal of error amplifier 200.

The feedback module 500 includes a third resistor R3 and a fourth resistor R4, wherein the current input is grounded by the third resistor R3 and the fourth resistor R4, the junction of the third resistor R3 and the fourth resistor R4 serves as a feedback terminal. The error amplifier 200 adjusts the output voltage VOUT by sampling and comparing the voltage of the fourth resistor R4 and the reference voltage of the voltage reference source module 100.

The power transmission device 400 is a field effect transistor, and in the present embodiment the power transmission device 400 is a P channel field effect transistor. The control terminal of the power transmission device 400 is the gate of the P channel field effect transistor, the switching input thereof is the source of the P channel field effect transistor, and the switching output thereof is the drain of the P channel field effect transistor.

The invention further discloses a chip and an electronic device.

A chip includes the low dropout linear regulator circuit described above.

An electronic device includes the low dropout linear regulator circuit described above.

The low dropout linear regulator circuit, the chip and the electronic device described above include a reference voltage determining module to detect whether the voltage reference source module has completed starting thereof or not. If the voltage reference source module has completed starting thereof, a starting signal is transmitted to the error amplifier, that is, by delaying the starting time of the error amplifier relative to the voltage reference source module, so that the error amplifier can effectively control the operation of the power transmission device, thus avoiding the voltage overshoot in the starting process of the output capacitor-less LDO circuit.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. A low dropout linear regulator circuit, comprising: a voltage reference source module, an error amplifier, a reference voltage determining module, a power transmission device, and a feedback module; wherein the voltage reference source module provides a reference voltage for the error amplifier, the reference voltage determining module controls an enablement of the error amplifier according to whether the voltage reference source module is completely started, the error amplifier controls ON/OFF of the power transmission device according to the reference voltage provided by the voltage reference source module and a feedback voltage provided by the feedback module.

2. The low dropout linear regulator circuit of claim 1, characterized in that, the circuit further comprises an input voltage terminal;

the voltage reference source module comprises a first out connected to an inverting input of the error amplifier, and a second output connected to a determining signal input of the reference voltage determining module;

the reference voltage determining module comprises the determining signal input, and a determining signal output connected to an enable of the error amplifier;

the error amplifier comprises the inverting input, the enable, an amplification signal output connected to a control terminal of the power transmission device, and a non-inverting input connected to a feedback terminal of the feedback module;

the power transmission device comprises the control terminal, a switching input connected to the input voltage terminal, and a switching output connected to a current input of the feedback module; and the feedback module comprises the feedback terminal and the current input.

3. The low dropout linear regulator circuit of claim 2, characterized in that, the reference voltage determining module further comprises a first transistor, a second transistor, a third transistor and a fourth transistor; wherein the third transistor and the second transistor forms a mirror current source, the input voltage terminal provides a reference current for the mirror current source;

a gate of the first transistor serves as the determining signal input, which is configured to control a gate of the second transistor to turn on the input voltage terminal or to be grounded;

a first electrode of the fourth transistor is connected to a common-gate terminal of the mirror current source, a second electrode of the fourth transistor is grounded, which is configured to control the mirror current source to provide a determining signal for the error amplifier.

4. The low dropout linear regulator circuit of claim 3, characterized in that, the input voltage terminal is connected to a first electrode of the first transistor, the first electrode of the second transistor, and a gate of the fourth transistor; second electrodes of the first transistor, the second transistor, the third transistor and the fourth transistor are grounded; the gate of the second transistor and a gate of the third transistor are connected to serve as the common-gate terminal of the mirror current source, the first electrode and the gate of the second transistor are short-connected, a first electrode of the third transistor serves as the determining signal output terminal.

5. The low dropout linear regulator circuit of claim 3, characterized in that, the circuit further comprises a first load network and a second load network; the input voltage terminal is connected to a first electrode of the first transistor by the first load network, the input voltage terminal is connected to a gate of the fourth transistor by the first load network, the input voltage terminal is connected to the first electrode of the second transistor by the second load network.

6. The low dropout linear regulator circuit of claim 5, characterized in that, the first load network is a first resistor, and the second load network is a second resistor.

7. The low dropout linear regulator circuit of claim 5, characterized in that, the first load network is a fifth transistor, and the second load network is a sixth transistor, the voltage reference source module is connected to a gate of the fifth transistor and a gate of the sixth transistor to provide a bias voltage.

8. The low dropout linear regulator circuit of claim 2, characterized in that, the feedback module further comprises a third resistor and a fourth resistor, the current input terminal is grounded by the third resistor and the fourth resistor, a junction of the third resistor and the fourth resistor serves as the feedback terminal.

9. The low dropout linear regulator circuit of claim 1 characterized in that, the power transmission device is a field effect transistor.

10. The low dropout linear regulator circuit of claim 1, characterized in that, further comprising a starting circuit module, the starting circuit module is configured to control starting of the voltage reference source module.

11. A chip, comprising a low dropout linear regulator circuit of claim 1.

12. An electronic device, comprising a chip of claim 11.

* * * * *